US006068869A

United States Patent [19]

Bent Ginslov

[11] Patent Number: 6,068,869

[45] Date of Patent: May 30, 2000

[54] METHOD OF PRODUCING A STABILIZED SUGAR CANE JUICE PRODUCT

[75] Inventor: Otto Peter Bent Ginslov, Waterfall, South Africa

[73] Assignee: Jucana Investment CC, South Africa

[21] Appl. No.: 09/030,786

[22] Filed: Feb. 25, 1998

[51] Int. Cl.[7] ..... C13K 3/00

[52] U.S. Cl. ..... 426/262; 426/49; 426/268; 426/481; 127/46.1; 127/50; 127/51; 127/55; 127/61

[58] Field of Search ..... 426/49, 48, 52, 426/262, 268, 541, 544, 590, 478, 481, 489; 127/43, 46.1, 50, 55, 61, 51, 36

[56] References Cited

U.S. PATENT DOCUMENTS

| | | | |
|---|---|---|---|
| 4,083,732 | 4/1978 | Paley | 127/48 |
| 4,288,551 | 9/1981 | Gudnason et al. | 127/48 |
| 4,332,622 | 6/1982 | Hohnerlein, Jr. et al. | 127/41 |
| 4,627,880 | 12/1986 | Langen et al. | 127/43 |
| 5,468,300 | 11/1995 | Monclin | 127/43 |

OTHER PUBLICATIONS

The Condensed Chemical Dictionary 10$^{th}$ Ed. Gessnerg, Harley (pp. 847, 780), 1981.

*Primary Examiner*—Milton Cano
*Assistant Examiner*—Hao Mai
*Attorney, Agent, or Firm*—Nields, Lemack & Dingman

[57] ABSTRACT

A method of providing a stabilized sugar cane juice product for use in soft drinks, that includes providing cleaned sugar cane sticks and extracting cane juice from the sticks. Thereafter, the extracted cane juice is acidified immediately upon extraction by feeding it into a solution comprising ascorbic acid for preventing discoloration of the cane juice and also by feeding it simultaneously into an acidic solution of one of citric acid, malic acid, tartaric acid, phosphoric acid and a mixture thereof, for lowering the pH of the cane juice below a pH of 5. Furthermore, one of a sodium citrate solution, a potassium citrate solution, a sodium phosphate di-basic solution or a mixture thereof, is added to the cane juice for stabilizing it. The cane juice is then coagulated and flocculated to remove unwanted foulants and aromas.

15 Claims, 2 Drawing Sheets

METHOD OF PRODUCING A STABILIZED SUGAR CANE JUICE PRODUCT

BACKGROUND OF THE INVENTION

The present invention relates to a method of producing a stabilised sugar cane juice product.

It is well known in many countries to drink the juice of freshly crushed sugar cane. However, it has not been possible to commercialize the provision of sugar cane juice because of very rapid discolouration of the juice from a pale yellow colour to brown. This is caused by the reaction of amino acids and sugar within the juice, commonly known as the "Maillard" reaction. This non-enzymatic reaction produces the brown pigment, melanoidin, which discolours the cane juice from its original pale yellow colour.

It is an object of this invention to overcome the above problem associated with sugar cane juice and thereby enable the provision of a cloudy or clear stabilised sugar cane juice product in commercially viable volumes and forms.

SUMMARY OF THE INVENTION

According to the invention there is provided a method of producing a stabilised cane juice product, which includes the steps of:

providing cleaned sugar cane sticks;

extracting sugar cane juice from said sugar cane sticks;

adding to the extracted sugar cane juice, a solution comprising ascorbic acid for preventing the discolouration of the cane juice, and one of citric acid, malic acid, tartaric acid, phosphoric acid, and a mixture thereof, for lowering the pH of the cane juice below that of natural untreated cane juice, and one of a sodium citrate solution, a potassium citrate solution, a sodium phosphate di-basic solution, and a mixture thereof, for stabilising the sugar cane juice; and coagulating and flocculating the sugar cane juice to remove unwanted foulants and aromas.

The acidifying solution may contain 100 to 400 mg ascorbic acid per liter of solution.

The citric acid, malic acid, tartaric acid, phosphoric acid or a mixture thereof, of the acidifying solution may be sufficient for reducing the pH of the cane juice to below 5.

The sodium citrate solution, potassium citrate solution, sodium phosphate di-basic solution or a mixture thereof, of the acidifying solution, may be a 0.01 to 0.1% (m/m) solution.

The cane juice may be allowed to stand undisturbed for a predetermined period of time immediately after acidification thereof, during which time coagulants and flocculants are added thereto.

The method may include filtering the cane juice after acidification thereof.

The filtration of the cane juice may be effected initially in two stages, with a first stage providing for the separation of particles having a size larger than five microns, from the cane juice, and a second filtration stage providing for the separation of particles having a size larger than one micron, from the cane juice, the cane juice having a cloudy appearance after filtration thereof.

In order to produce a substantially clear sugar cane juice, the method may include filtering the cane juice through a diatomaceous earth filter.

In order to further clarify the sugar cane juice, the method may include further filtering the cane juice in a tubular ultra-filtration system comprising two tubular ultra-filtration modules forming part of a continuous ultra-filtration process in which a first ultra-filtration module filters out particles in the cane juice having a particle size larger than $45000\times10^{-9}$ m, and in which a second ultra-filtration module filters out particles having a particle size larger than $5000\times10^{-9}$ m.

The filtered cane juice may be stored and the Brix and pH of the cane juice adjusted, if required, the Brix being adjusted to between 10 and 14° Brix and the pH being adjusted to between 1.4 and 4.9, with the pH adjustment being effected by adding one of citric acid solution, malic acid solution, tartaric acid solution, phosphoric acid solution, and a mixture thereof. The method may include a sugar inversion process during the storage thereof, whereby substantially the entire sucrose content of the juice is converted into fructose and glucose by the addition of suitable enzymes into the cane juice.

The enzyme quantity added may be between 50 and 100 mg per liter of juice.

The enzyme added to the cane juice may be an enzyme known as "Invertase".

The sugar inversion process may include heating the cane juice to approximately 60° C. immediately after adding the enzyme thereto.

The method may include the addition of one or more of a group comprising fruit juices, flavourings, colouring agents, 0.1 and 1% (m/m) citrus pectin to the cane juice.

The method may include pasteurisation of the cane juice after the storage thereof.

The method may include the addition of suitable preservatives for extending the shelf life of the sugar cane juice product.

The method may include removing water from the sugar cane juice product to form a sugar cane juice concentrate.

The method may include removing water from the sugar cane juice product by an evaporation process.

The method may include carbonating the sugar cane juice product.

The invention extends to a stabilised cane juice product manufactured in accordance with the method defined hereinabove.

DESCRIPTION OF THE PREFERRED EMBODIMENTS

Figure 1:
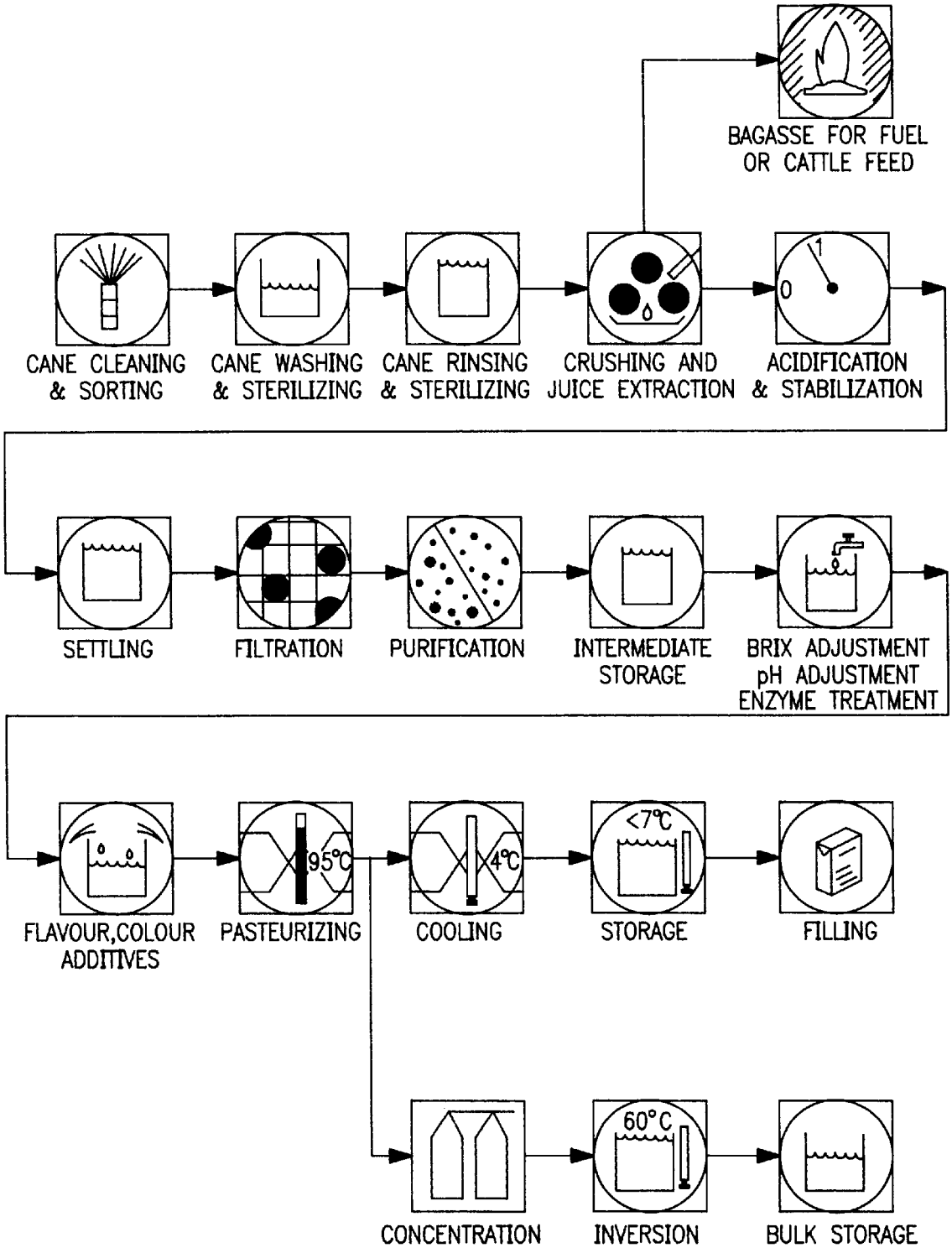
Figure 2:
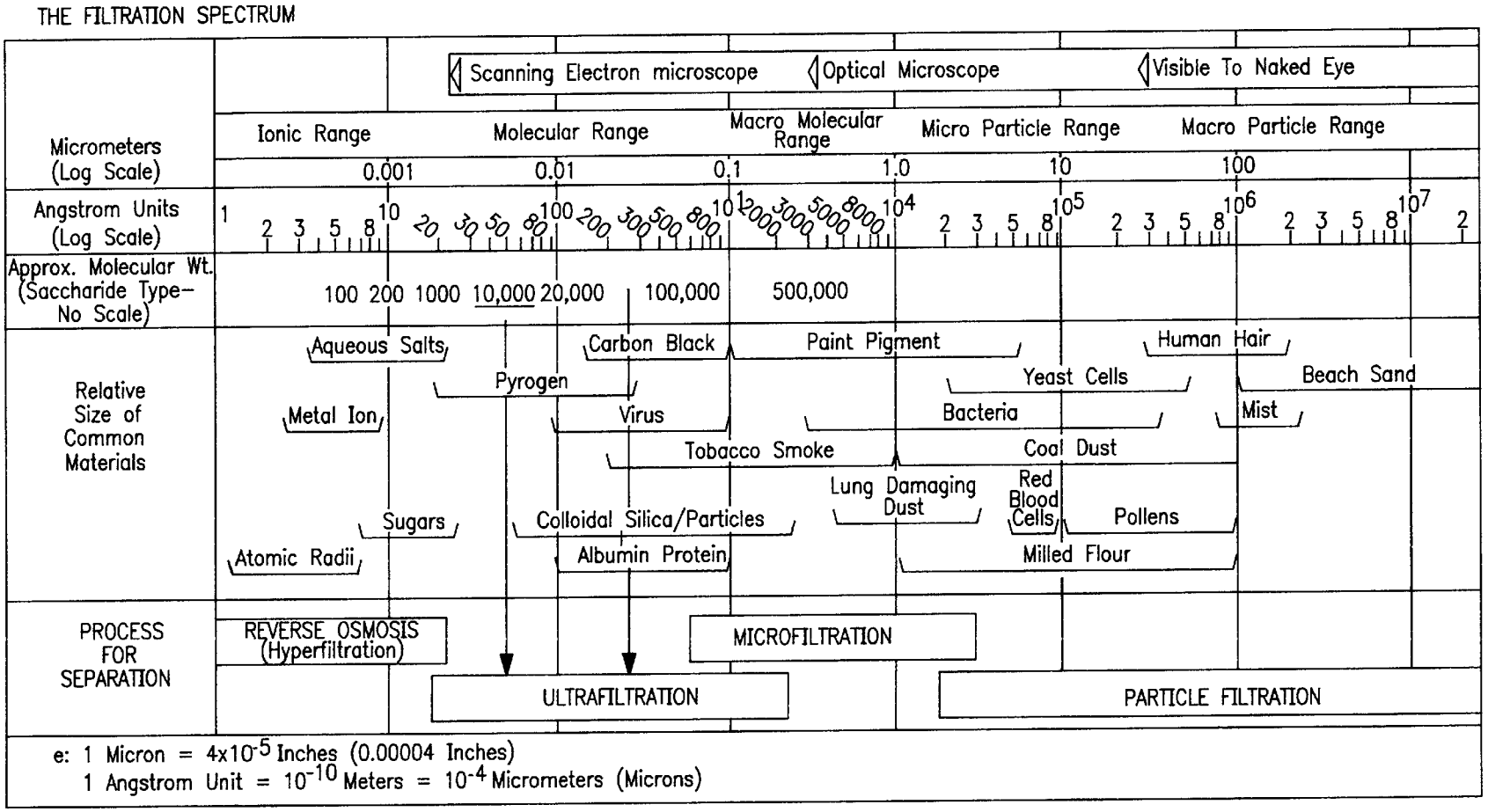

Further features of the method of producing a stabilised sugar cane juice product, as defined hereinabove, is described in more detail hereinafter by way of a non-limiting example of the method of the invention, with reference to and as illustrated by way of the accompanying diagrams. In the drawings:

FIG. 1 shows a block diagram of a method of producing a stabilised sugar cane juice product in accordance with the invention; and FIG. 2 shows a block diagram depicting the sizes of particles which can be separated in an ultrafiltration process.

Referring to the diagrams, the method of producing a stabilised cane juice product in accordance with the invention, includes the first step of providing freshly cut and thrashed sugar cane sticks having all loose leaves removed. These sugar cane sticks can then be transported to the factory where the cane juice product of the invention is to be produced and where the cane sticks are immediately cleaned and all new buds, diseased parts, roots and tops cut off. All waste so collected typically can be used for fuel.

The clean sugar cane sticks are then sterilised by firstly being scrubbed in a water bath containing 0.1 to 1% (m/m) quaternary ammonium compound solution, which is known to be effective for sterilising purposes. This solution is particularly suitable for destroying harmful bacteria associated with the sugar cane sticks and any soil attached thereto. The cane sticks are thereafter rinsed in a sterilising solution containing between 50 and 200 ppm chlorine, the chlorine solution being of common commercial grade.

After allowing the main part of the sterilising solution to "drip off" from the cane sticks, the cane sticks can be crushed in a roller crusher having a suitable number of crusher rollers that will ensure that at least 90% of the sugar cane juice is extracted from the cane sticks. The sugar cane juice also can be separated by any other method or technique. The Bagasse waste can again be used for fuel.

Immediately upon the extraction of the sugar cane juice, it can be fed into an ascorbic acid solution containing between 100 and 500 mg ascorbic acid per liter, for preventing the discolouration of the cane juice. Simultaneously, an acidic solution of one of citric acid, malic acid, a tartaric acid, phosphoric acid and a mixture thereof, is added in order to reduce the pH of the cane juice to below 5, whereas a basic solution of one of sodium citrate, potassium citrate, sodium phosphate di-basic and a mixture thereof, is also simultaneously added for stabilising the acidic solution. The ascorbic acid has proved to be particularly suitable for preventing discolouration of the extracted sugar cane juice, even after pasteurisation treatment as envisaged hereafter. The basic solution is a 0.01 to 0.1% (m/m) solution.

During the stabilisation of the cane juice as described above, the cane juice must be left undisturbed for approximately one hour, i.e. after the abovementioned solutions have been added thereto. During this period the cane juice is coagulated and flocculated to remove unwanted foulants and aromas. The Applicant believes that a range of polycrylamide-based cationic coagulants as well as high molecular weight anionic polyelectrolyte flocculants may be used. The dosage of coagulants and flocculants must not exceed 35 mg/l. To further eliminate any residual odours and colours a further treatment of activated carbon may be used. The coagulants, flocculants and activated carbon must be of approved F.D.A. regulations (USA) and D.O.E. regulations (UK) as well as the regulations of the Department of National Health and Population Development (R.S.A.).

The said impurities can then be easily separated in a clarifying process, whereafter the juice is firstly filtered through a five micron filtration bag system which will remove remaining course particles from the juice and then a one micron filtration bag system for separating smaller particles. This filtration will result in the provision of a cloudy sugar cane juice that is pale yellow with no visible impurities and no sedimentation. To produce a substantially clear sugar cane juice, the juice is filtered through a diatomaceous earth filter.

In order to further clarify the cane juice, the cane juice is passed through a Tubular Ultrafiltration system. Referring to FIG. 2 of the drawings, in the Tubular Ultrafiltration system, the cane juice is further filtered in a first ultrafiltration module which filters out particles in the cane juice having a particle size larger than $40000\times10^{-9}$ m and thereafter the cane juice is filtered in a second ultrafiltration module which filters out particles in the cane juice having a particle size larger than $5000\times10^{-9}$ m. In trials performed on ultrafiltration of cane juice, the ultrafiltration equipment comprised a self-contained, food grade pilot plant equipped with two tubular ultrafiltration modules. The ultrafiltration system was operated in a batch wise manner with recirculation of cane juice to be filtered. The feed pressures ranged from 200 kPa to 600 kPa and the feed temperature varied from 25° C. to 60° C. In a test performed on the cane juice after filtration, it was found that very little loss of colour occurred when the filtered cane juice was concentrated from approximately 17° Brix to about 70° Brix. If considered necessary, filtration may be accompanied by de-flavouring.

During intermediate storage of the juice after filtration, the Brix can be adjusted to between 10 and 14° Brix, such adjustment being done by using potable water. A further pH adjustment also can then be effected in order to provide for the pH of the juice to be between 1.4 and 4.9. The addition of one of citric acid, malic acid, tartaric acid, phosphoric acid and a mixture thereof, can be utilised for this purpose.

This intermediate storage stage may be accompanied by the inversion of the sucrose content of the juice into fructose and glucose. This can be done by adding between 50 mg and 100 mg "Invertase" enzymes into each liter of juice and heating the mixture to 60° C., at which temperature the mixture will remain for approximately 6 hours. This will allow the conversion to take place and effectively eliminate all sucrose from the juice. The conversion method also can be carried out in any other way that is effective and viable. If a concentrated form of the stabilised or inverted sugar cane juice is required for transportation and further processing elsewhere, then the Brix of the juice can be adjusted to between 65 and 82° Brix, such adjustment being done by the use of an evaporator for evaporating and concentrating the juice at a temperature below 60° C. at a high vacuum. When the required Brix has been reached, the concentrated syrup is pasteurised between 75° C. and 95° C. and held for not less than 3 minutes before being cooled down to ambient temperature.

After the above adjustment and inversion, a 0.1 to 1% (m/m) citrus pectin (purified food grade) solution is added to the sugar cane juice and, if required, other fruit juice concentrates, flavouring and/or colourings can be added in order to provide a desired type end product. Thereafter, the resulting sugar cane juice, or sugar cane juice concentrate, with or without flavouring agents and other additives, can be pasteurised, typically at between 90 and 95° C. for 15 to 25 seconds, whereafter the juice can be cooled to below 4° C. This can be carried out in a standard plate heat exchanger as is commonly used. In tests performed on filtered cane juice, it was found that during pasteurisation of the cane juice, the cane juice can be heated up to 95° C. for 5 minutes without colour or flavour deterioration of the cane juice.

The pasteurised juice can then be contained in a bulk container at a temperature preferably below 4° C. and final quality control checks can then be carried out. This is followed by filling the sugar cane juice into commercial trade containers in which the sugar cane juice can be finally provided to the public. It is anticipated that without any further preservatives and by keeping the juice refrigerated below 4° C., the juice will have a shelf life of approximately one month, whereas together with suitable preservatives, this can be extended to between 2 and 3 months. The cane juice can also be Ultra-High Temperature (UHT) treated at temperatures above 100° C. for a few seconds in an aseptic UHT system. The shelf life can now be extended to approximately 6 months without refrigeration.

It is believed that one or more of the individual steps associated with the method of producing a stabilised sugar cane juice product, as described above can be varied in various different respects while still incorporating the principles associated with the method of manufacturing a stabilised cane juice product, as hereinabove described and defined. For industrial applications, the juice can be concentrated after pasteurisation, or otherwise treated.

The final properties of the sugar cane juice drink also are greatly variable and will be particularly determined by the additives that can be added to the juice in order to provide a juice with desired qualities.

What is claimed is:

1. A method of producing a stabilised cane juice product, which includes the steps of:

providing cleaned sugar cane sticks;

extracting sugar cane juice from said sugar cane sticks;

adding to the extracted sugar cane juice, a solution comprising ascorbic acid for preventing the discoloration of the cane juice, and a member selected from the group consisting of citric acid, malic acid, tartaric acid, phosphoric acid, and a mixture thereof, for lowering the pH of the cane juice, and a member selected from the group consisting of a sodium citrate solution, a potassium citrate solution, a sodium phosphate di-basic solution, and a mixture thereof, for stabilising the sugar cane juice;

coagulating and flocculating the sugar cane juice to remove unwanted foulants and aromas;

filtering the sugar cane juice; and storing the filtered sugar cane juice.

2. A method as claimed in claim 1, wherein the acidifying solution contains 100 to 400 mg ascorbic acid per liter of solution.

3. A method as claimed in claim 1, wherein the citric acid, malic acid, tartaric acid, phosphoric acid or a mixture thereof, of the acidifying solution is sufficient for reducing the pH of the cane juice to below 5.

4. A method as claimed in claim 1, wherein the sodium citrate solution, potassium citrate solution, sodium phosphate di-basic solution or a mixture thereof, of the acidifying solution, is a 0.01 to 0.1% (m/m) solution.

5. A method as claimed in claim 1, wherein the cane juice is allowed to stand undisturbed for a predetermined period of time immediately after acidification thereof, during which time coagulants and flocculants are added thereto.

6. A method as claimed in claim 1, wherein the filtration of the cane juice is effected initially in two stages, with a first stage providing for the separation of particles having a size larger than five microns, from the cane juice, and a second filtration stage providing for the separation of particles having a size larger than one micron, from the cane juice, the cane juice having a cloudy appearance after filtration thereof.

7. A method as claimed in claim 6, further comprising the step of filtering the cane juice through a diatomaceous earth filter.

8. A method as claimed in claim 7, further comprising the step of filtering the cane juice in a tubular ultra-filtration system to produce a substantially clear cane juice product, the ultra-filtration system comprising two tubular ultra-filtration modules forming part of a continuous ultra-filtration process in which a first ultra-filtration module filters out particles in the cane juice having a particle size larger than $45000\times10^{-9}$ m, and in which a second ultra-filtration module filters out particles having a particle size larger than $5000\times10^{-9}$ m.

9. A method as claimed in claim 6, wherein the Brix and pH of the filtered and stored cane juice is adjusted, if required, the Brix being adjusted to between 10 and 14° Brix and the pH being adjusted to between 1.4 and 4.9, with the pH adjustment being effected by adding one of citric acid solution, malic acid solution, tartaric acid solution, phosphoric acid solution, and a mixture thereof.

10. A method as claimed in claim 9, further comprising the step of pasteurizing of the cane juice after the storage thereof.

11. A method as claimed in claim 1, further comprising the step of adding of one or more of a group comprising fruit juices, flavourings, colouring agents, and between 0.1 and 1% (m/m) citrus pectin to the cane juice.

12. A method as claimed in claim 1, further comprising the step of adding preservatives for extending the shelf life of the sugar cane juice product.

13. A method as claimed in claim 1, further comprising the step of removing water from the sugar cane juice to form a sugar cane juice concentrate.

14. A method as claimed in claim 13, further comprising the step of removing water from the sugar cane juice product by an evaporation process.

15. A method as claimed in claim 1, further comprising the step of carbonating the sugar cane juice.

* * * * *